US006522313B1

(12) United States Patent
Cottone

(10) Patent No.: US 6,522,313 B1
(45) Date of Patent: Feb. 18, 2003

(54) CALIBRATION OF SOFTCOPY DISPLAYS FOR IMAGING WORKSTATIONS

(75) Inventor: Patrick L. Cottone, East Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 300 days.

(21) Appl. No.: 09/660,821

(22) Filed: Sep. 13, 2000

(51) Int. Cl.[7] ..... G09G 1/14

(52) U.S. Cl. ..... 345/22; 345/589; 345/593; 348/181

(58) Field of Search ..... 345/10, 11, 12, 345/20, 22, 593, 594, 595, 597, 601, 602, 604, 589; 348/180, 181, 179, 182, 184; 382/167, 518

(56) References Cited

U.S. PATENT DOCUMENTS 5,371,537 A * 12/1994 Bohan et al. ..... 348/181
5,739,809 A * 4/1998 McLaughlin et al. ..... 345/594
5,754,222 A * 5/1998 Daly et al. ..... 348/184
6,160,644 A * 12/2000 Lin ..... 358/518

* cited by examiner

*Primary Examiner*—Xiao Wu
(74) *Attorney, Agent, or Firm*—David M. Woods

(57) ABSTRACT

A method of calibrating a multichannel display device having an overall and individual channel adjustment for both gain and offset and an adjustment to provide a white point for the display, the white point including color temperature, chromaticity and luminance level, includes the steps of: displaying a first target using a low level code value for each channel of the display; sensing the luminance level of the displayed first target; adjusting the gain of the display so that the sensed luminance level matches a first predetermined aim value representing a luminance level at least 3 decades lower than a maximum luminance level; displaying a second target using intermediate code values for each channel of the display device; sensing the luminance level and chromaticities of the displayed second target; adjusting the individual channel offsets so that the luminance level matches a second predetermined aim value representing an intermediate luminance level and the chromaticities match a first set of predetermined chromaticities that represent a desired white point; displaying a third target using maximum code values for each channel of the display; sensing the luminance level and chromaticities of the displayed third target; adjusting the individual channel gains so that the luminance level matches a third predetermined aim value the maximum luminance level and the chromaticities match the first set of predetermined chromaticities; and repeating the steps of displaying and adjusting until no further adjustment is required in the last step.

8 Claims, 4 Drawing Sheets

CALIBRATION OF SOFTCOPY DISPLAYS FOR IMAGING WORKSTATIONS

FIELD OF THE INVENTION

The invention relates generally to the field of display technology, and in particular to a process to color calibrate the light output of a display.

BACKGROUND OF THE INVENTION

This invention provides a process to color calibrate the light output response of a display. In today's digital imaging world, many images are previewed and manipulated on softcopy displays. Imaging workstation displays are intended to simulate or match the look of hardcopy output, thus there is a need to calibrate softcopy displays to match hardcopy output. A process that has been used to calibrate displays used in high quality photographic imaging workstations is described in U.S. Pat. No. 5,371,537, "Method and Apparatus for Automatically Calibrating a CRT Display," A. E. Bohan et al., assigned to Eastman Kodak Company, issued Dec. 6, 1994. The patent by Bohan et al. teaches a method to calibrate a CRT display by mapping a CRT response curve to Aim Tone-Scale with the use of look-up tables for the individual channels. Such methods provide CRT calibration, but the calibration technique may limit the use of many digital code values when setting the display aim luminance and color to the application specification to get the display to the aim white point. Thus when the display brightness level continues to decrease over time, and further calibration is required, fewer and fewer code values are available, thereby restricting the total dynamic range per channel of the display. Display image quality can further suffer due to the quantizing effect of using fewer code values throughout the dynamic range. In the digital code value range one can only achieve the desired aim white level and color by decreasing the overall brightness of the display. In effect, the code values at the top of the range are sacrificed to achieve color balance.

There is a need therefore for an improved method of calibrating a multichannel soft copy display.

SUMMARY OF THE INVENTION

The present invention is directed to overcoming one or more of the problems set forth above. Briefly summarized, according to one aspect of the present invention, a method of calibrating a multichannel display device having an overall and individual channel adjustment for both gain and offset and an adjustment to provide a white point for the display, the white point including color temperature, chromaticity and luminance level, comprises the steps of: displaying a first target using a low level code value for each channel of the display; sensing the luminance level of the displayed first target; adjusting the gain of the display so that the sensed luminance level matches a first predetermined aim value representing a luminance level at least 3 decades lower than a maximum luminance level; displaying a second target using intermediate code values for each channel of the display device; sensing the luminance level and chromaticities of the displayed second target; adjusting the individual channel offsets so that the luminance level matches a second predetermined aim value representing an intermediate luminance level and the chromaticities match a first set of predetermined chromaticities that represent a desired white point; displaying a third target using maximum code values for each channel of the display; sensing the luminance level and chromaticities of the displayed third target; adjusting the individual channel gains so that the luminance level matches a third predetermined aim value the maximum luminance level and the chromaticities match the first set of predetermined chromaticities; and repeating the steps of displaying and adjusting until no further adjustmeent is required in the last step.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the advantage of setting the display luminance's dynamic range to the dynamic range of a hardcopy media. For example, it is capable of achieving greater than 3 decades of luminance range. It has the further advantage that the display uses internal and external controls to set up the aim color white point for desired application. The display white chromatics are customized then to the white of the hardcopy media. Using the present invention, an aim calibration worksheet including input signal, with light output aims in terms of color chromaticities and luminance, with corresponding controls can be prepared so that all of the information regarding the color calibration can be displayed at once. Robust performance of Gray Scale tracking is achieved by trading off lowlights color performance.

DETAILED DESCRIPTION OF THE INVENTION

Because image processing systems employing calibrated image workstations are well known, the present description will be directed in particular to attributes forming part of, or cooperating more directly with, apparatus in accordance with the present invention. System attributes not specifically shown or described herein may be selected from those known in the art. In the following description, a preferred embodiment of the present invention would ordinarily be implemented as a software program, although those skilled in the art will readily recognize that the equivalent of such software may also be constructed in hardware. Given the system as described according to the invention in the following materials, software not specifically shown, suggested or described herein that may be useful for implementation of the invention is conventional and within the ordinary skill in such arts. If the invention is implemented as a computer program, the program may be stored in conventional computer readable storage medium, which may comprise, for example; magnetic storage media such as a magnetic disk (such as a floppy disk or a hard drive) or magnetic tape; optical storage media such as an optical disc, optical tape, or machine readable bar code; solid state electronic storage devices such as random access memory (RAM), or read only memory (ROM); or any other physical device or medium employed to store a computer program.

The present invention uses the internal display gains and offsets to color calibrate the display to a custom color aim. The process utilizes the full dynamic range of the display with provision to be re-calibrated to the same white point aim over time without brightness penalty as in previous methods. Moreover a digital Look up Table (LUT) that represents the display calibration can then be used fully to represent desired output media characteristics.

Figure 1:
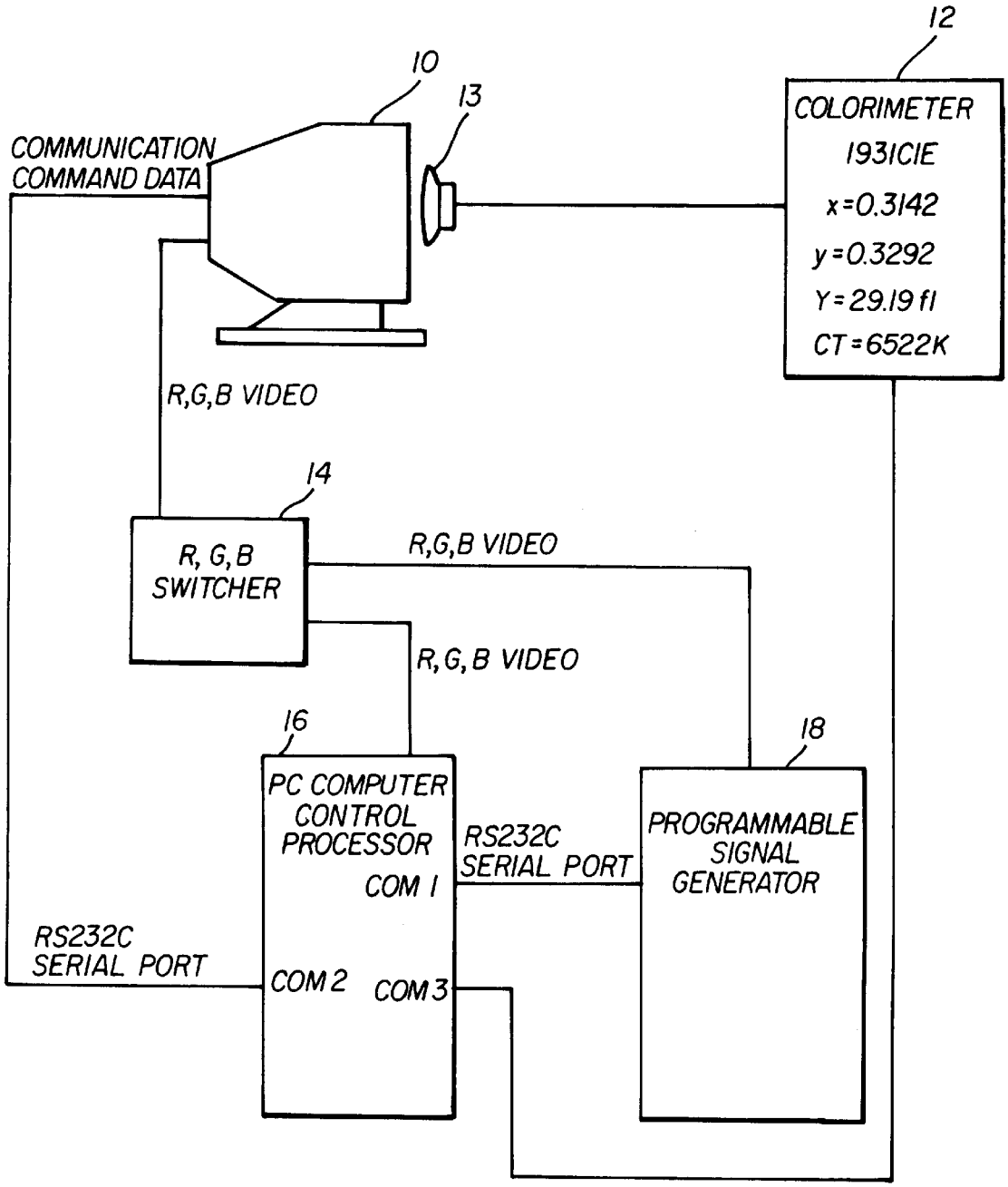
FIG. 1 is a block diagram of the display calibration hardware.

Referring to FIG. 1 a system useful in performing the calibration of a color Imaging workstation display 10 is shown. The components of the system include a colorimeter 12 with sufficient sensitivity and accuracy to measure the display luminance dynamic range. A preferred calorimeter is the LMT C2200 available from Lichtmesstechnik Gmbh Berlin Germany, which has provision to read the measured light output via computer or manually using its built in display. The colorimeter 12 includes a detector 13 that attaches to the face of the display 10. The colorimeter is interfaced to a central processing unit 16 via RS232C serial port or can be used in a real time measurement mode visually displaying the display color response to the user. The color response data is presented to the operator in terms of the 1931 CIE chromaticity specification, therefore the s, y, Y and color temperatures are reported and displayed. These are the metrics which will be used to calibrate the workstation display light output response. The system includes means to produce video signals with the appropriate timing parameters to produce test patches to be displayed on the display monitor 10. One means for producing these video signals is to use a programmable signal generator 18, such as an ASTRO Model 819 programmable signal generator, to generate analog signals to produce test patterns that include the test patches. The test patterns are such that the timing and level match the display input specification of the display 10.

Alternatively the test patterns are generated by the central processing unit 16 of the workstation which includes an internal graphics driver (not shown) to produce the required test patterns. This method is the preferred method to deliver the test pattern in an imaging workstation system environment. Using the internal graphics board will utilize the actual signal voltages to drive the display in the workstation system. A video switcher 14 can be used to select from either the signal generator 18 signals or the central processing unit 16 signals. The calibration process will compensate for input signal variations between channels; thus the best system calibration is obtained. The test patterns can be generated in the central processing unit 16 using commercial available software packages such as Adobe Photo Shop. One can also create a custom software program to produce test patches for calibration using the command structure for the graphic driver board. Another method is to have the test pattern stored on disk, like Photo CD and utilize the workstation Image display utilities to display the image of the test pattern. The central processing unit 16 also functions as the communication link between the operator and the display via another RS232C communication interface.

In operation, command data is entered into the display internal registers controlling the display color gains and offset controls for the display color calibration. Environmental concerns such as temperature, humidity, electromagnetic fields, ambient light levels and vibration, etc. are addressed and action taken before a white balance calibration is undertaken.

The next step in the calibration process is to determine the color aim for the imaging workstation display. To mimic many photographic media on the display 10 it is preferred that the white point chromaticities of the display match those of the photographic output medium. A common illuminant chromaticity for photographic application is D50 illuminant, having chromaticity coordinates x=0.3457 and y=0.3585. Custom white points can also be derived through actual measurement of a medium with desired illuminants; thus these chromaticities will be used for the display white point aim.

A key feature to this invention is to set the display (softcopy) luminance dynamic range to be equal or greater than the density dynamic range of the intended hardcopy. For example, a photographic media could have a typical density range from 0.05 density for (Dmin) to 2.5 density (Dmax), thus less than 2 decades of range. According to the present invention, to achieve the desired dynamic range, the black of the display is set 3 or more decades down from the display peak white level. For example, for a display having a peak white level of 30 footlamberts, the black is set to 0.03 footlamberts, thus providing at least three decades of luminance range. In practice one would always err to have greater range in the display then the intended hardcopy media range. In the example given above, the media range was much less then three decades thus having three decades in the display is more than sufficient for this application.

With the aim white point determined, one is ready to start the display calibration process. Table 1 shows a typical calibration worksheet used with the method of the present invention. The worksheet is used as a guide and a recipe to automate the display calibration process.

TABLE 1

| | | | SUN 20E20 Worksheet<br>SUN 20E20 Data | | | | |
|---|---|---|---|---|---|---|---|
| Code Value | Aim | | Red | Green | Blue | Misc. | |
| 50 | | 0.45 | | | | G2 = | |
| 50 | | 0.45 | | GkBrC = | | | |
| 0 | 1.0 | .283/.298 | RkBrMx = | GkBrMx = | BkBrMx = | | |
| 255 | 23.5 | .283/.298 | | Gdrive = | Bdrive = | CmxBmx = | |
| 77 | | .283/.298 | RkBrC = | | BkBrC = | | |
| 255 | 21.0 | .283/.298 | | Gdrive = | Bdrive = | CmxBmn = | |
| 77 | | | | | | | |
| 255 | 2.33 | .283/.298 | | | | Cmin = | |
| 255 | Confirm | | | | | | .283/.298 |
| 0 | 1.0 | .313/.329 | RkBrMx = | GkBrMx = | BkBrMx = | | |
| 255 | 23.5 | .313/.329 | | Gdrive = | Bdrive = | CmxBmx = | |

TABLE 1-continued

| | | | | SUN 20E20 Worksheet SUN 20E20 Data | | | | |
|---|---|---|---|---|---|---|---|---|
| Code Value | Aim | | | Red | Green | Blue | Misc. | |
| 77 | | .313/.329 | | RkBrC = | | BkBrC = | | |
| 255 | 21.0 | .313/.329 | | | Gdrive = | Bdrive = | CmxBmn = | |
| 77 | | | | | | | | |
| 255 | 2.33 | .313/.329 | | | | | Cmin = | |
| 255 | Confirm | | | | | | | .313/.329 |
| 0 | 1.0 | .345/.358 | | RkBrMx = | GkBrMx = | BkBrMx = | | |
| 255 | 23.5 | .345/.358 | | | Gdrive = | Bdrive = | CmxBmx = | |
| 77 | | .345/.358 | | RkBrC = | | BkBrC = | | |
| 255 | 21.5 | .345/.358 | | | Gdrive = | Bdrive = | CmxBmn = | |
| 77 | | | | | | | | |
| 255 | 2.33 | .345/.358 | | | | | Cmin = | |
| 255 | Confirm | | | | | | | .345/.358 |
| 50 | | | 0.45 | | | | G2 = | |

Rec File name _____
Cal File name _____

The code value column represents the video signal in terms of input code values to the display. The test patterns are a series of patches with these code values representing the level of the patch. The test patches can be generated via a programmable signal generator or the preferred method of using the graphics card in the central processing unit 16. The next column labeled aim, on the worksheet, represents the display light output aim in terms of luminance or color chromaticity or both depending on the step. The next four columns are related to the internal controls of the display, which will be adjusted to achieve the aim. In the example shown, controls are provided for Red, Green, and Blue gains and offsets, the actual controls provided may vary between different displays.

According to the present invention, the calibration process is a repeated series of sequential steps of making adjustments to the internal gain and offsets. The interaction between setting gain and offsets requires repeated iteration through the calibration process to arrive at the most robust settings.

Many displays provide for more than one color calibration implemented into the display. In Table 1, three different calibrations are shown. The end of each calibration is shown by "confirm" in the Aim column. After the last "confirm" the first step setting the black level is tested to confirm that the black level has not changed. Once the calibration process is complete the operator has a completed worksheet with the control value entered or a file with the information saved. The information can be used for reference or staring point data information for other displays.

Figure 2:
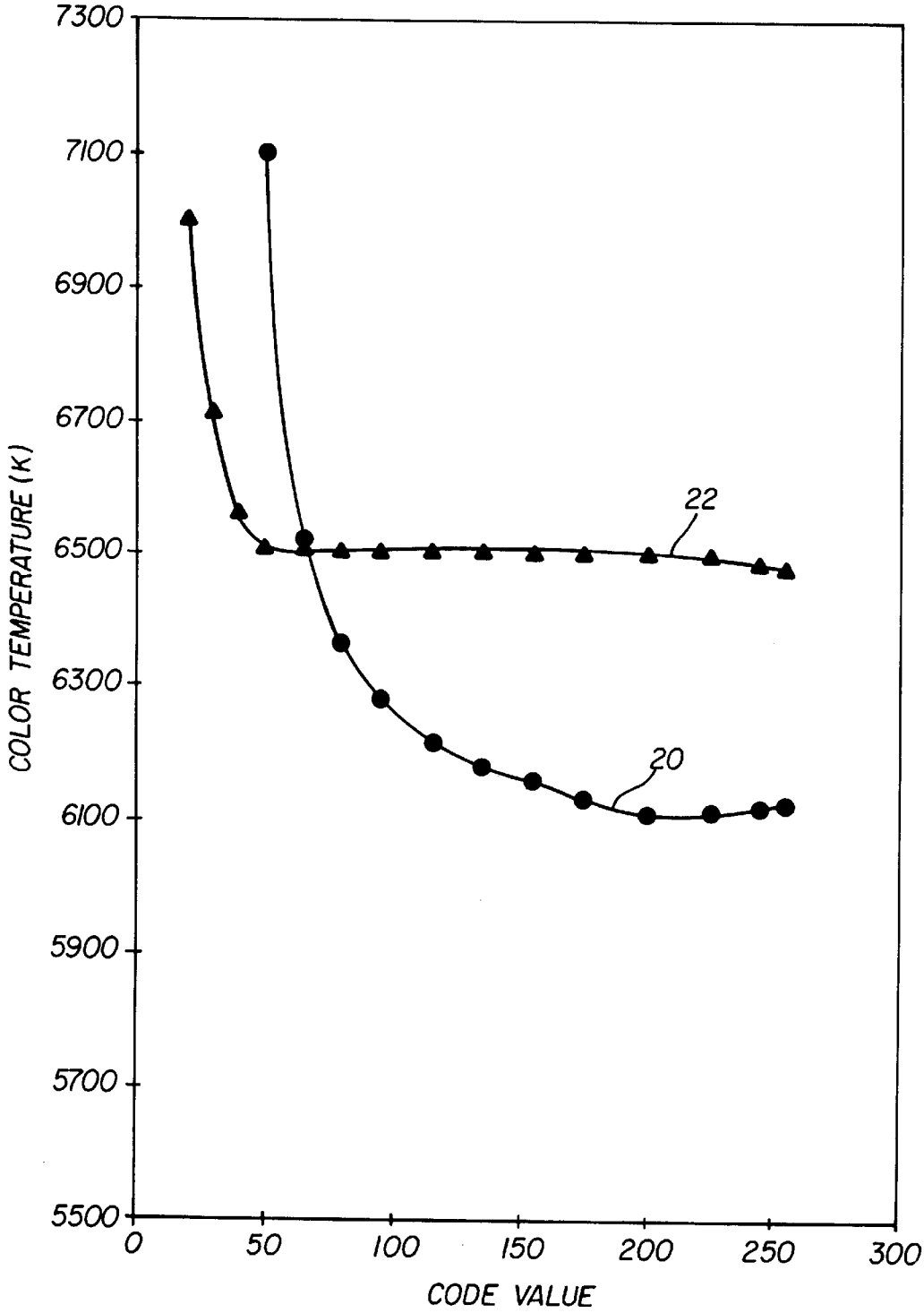
FIG. 2 is a plot of the color temperature response of a Sun Model 20E20 Display before and after calibration is applied.
Figure 3:
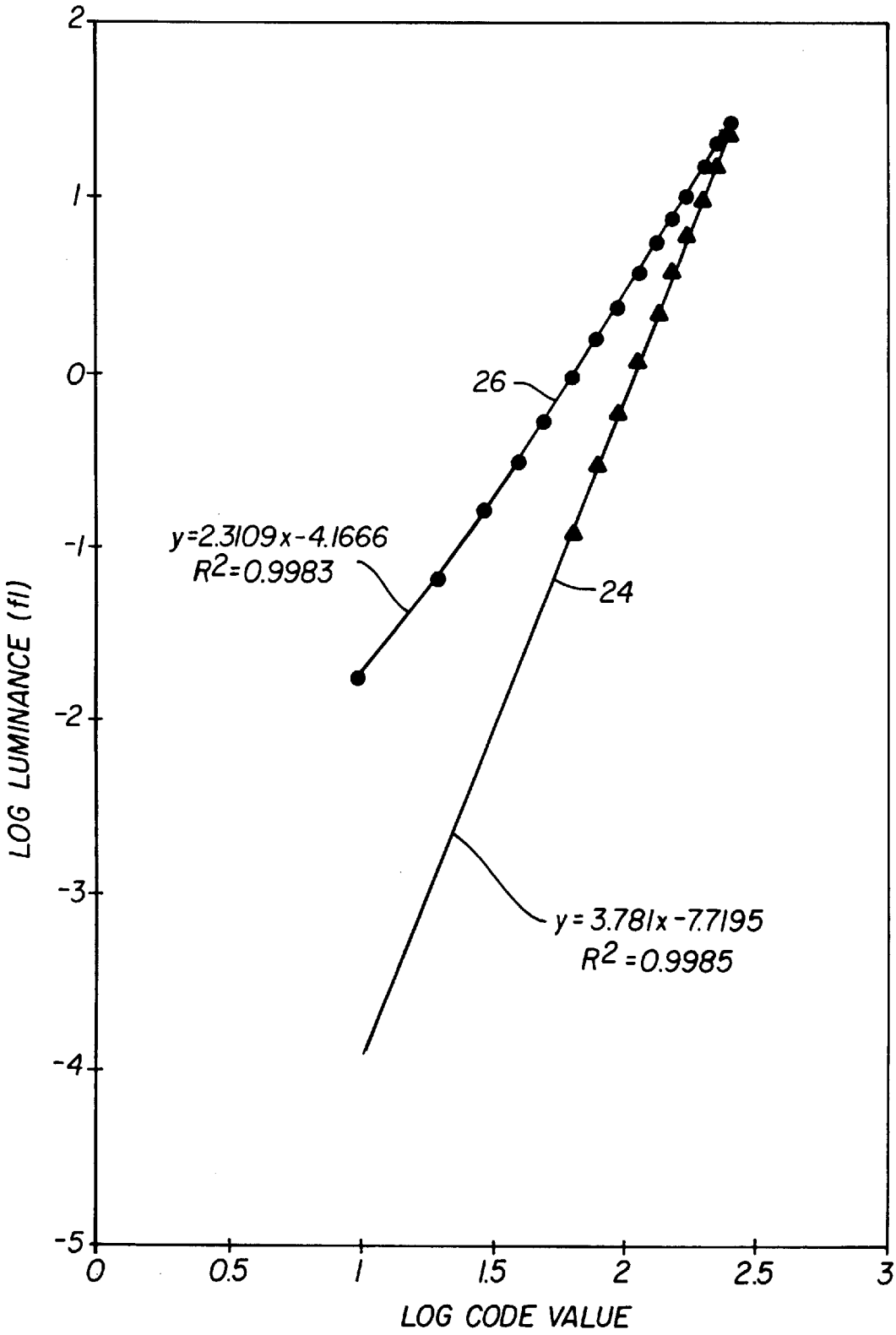
FIG. 3 is a plot of the log Luminance response of a Sun Model 20E20 Display before and after calibration is applied.

FIG. 2 is a plot of the Color Temperature versus Input Code Value of a Sun 20E20 display showing the color performance before 20 and after 22 calibration according to the present invention. This plot shows the improvement in color tracking response as a result of the calibration. The color temperature vs. code value of the display is constant to within ±200° K. from a code value of 50 to 255 for an 8-bit per channel display. This range corresponds to the visible color range of the display since colors are not visible in the lower code value regions of the display. For displays having a greater number of bits, a similar result is expected. FIG. 3 is a plot of the log Luminance versus Input Code Value for the Sun 20E20 display. The plot shows the improvement in luminance range before 24 and after 26 calibration according to the present invention.

Figure 4:
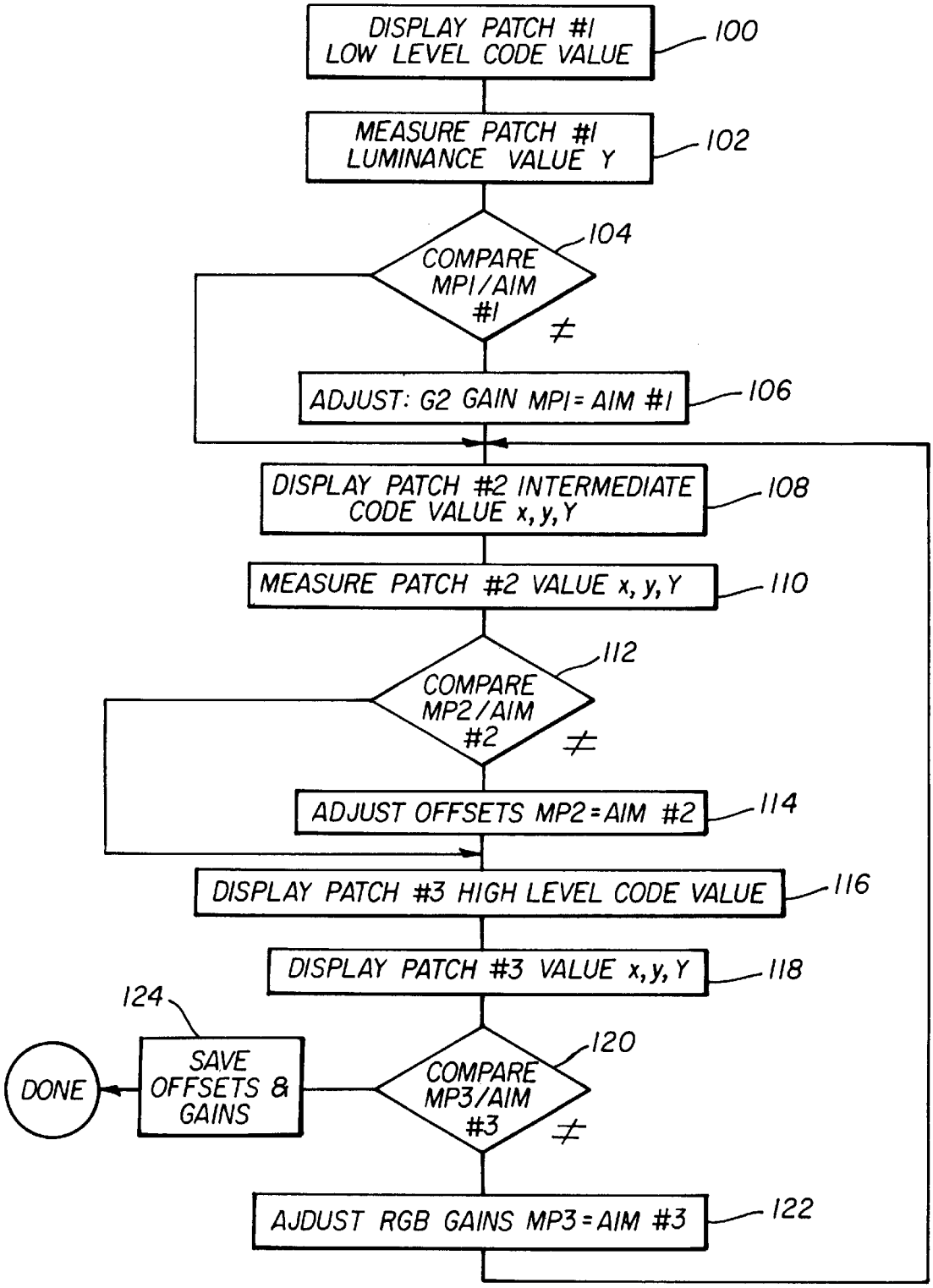
FIG. 4 is a flow chart showing the display calibration process according to the present invention.

Referring to FIG. 4, the calibration method for providing a white point for the display 10, the white point including color temperature, chromaticity and luminance level, according to one embodiment of the invention will be described in detail. First, a first target (display patch #1) is 100 using a low level code value for each channel of the display. The detector 13 is located on the display over the display patch #1 and the luminance level of display patch #1 is sensed 102 by the detector 13 of calorimeter 12 to measure a luminance value Y of the display patch. The gain of the display is then compared 104 to the Aim for display patch #1 and adjusted 106 so that the sensed luminance level matches the first predetermined aim value representing a luminance level at least 3 decades lower than a maximum luminance level.

A second target (display patch #2) is displayed 108 using intermediate code values for each channel of the display device. The luminance level and chromaticities of the displayed second target are sensed 110. The sensed values are compared 112 to the aim values for display patch #2. The individual channel offsets are adjusted 114 so that the luminance level matches a second predetermined aim value representing an intermediate luminance level, he chromaticities match a first set of predetermined chromaticities that represent a desired white point. To match the color metric of the display to the color metric of a hardcopy medium, the chromaticity and luminance level of a hard copy display medium under illumination conditions corresponding to its intended use can be measured to produce the first set of predetermined chromaticities and the desired white point.

A third target (display patch #3) is displayed 116 using high level code values, preferably maximum code values, for each channel of the display.

The luminance level and chromaticities of display patch #3 are sensed 118. The sensed values are compared 120 to the aim values for display patch #3 and the individual channel gains are adjusted 122 so that the luminance level matches a third predetermined desired luminance level and the chromaticities match the first set of predetermined chromaticities.

Next, the second target 108 is displayed again and the process outlined above is repeated until no further adjustment is required when the third target is displayed 116 and measured 118. The offsets and gains are then saved 124.

Using more test targets 100, 108, 116 than discussed above employs enhancements to the overall calibration curve shape. The trade off will be that in the time allowed to iterate through more steps thus the calibration process will take longer to execute.

The steps of the present invention are preferably implemented in a software program that is run by the control processor 16. The software controls the entire display screen so that when the test patches are being displayed, no other features are displayed. Alternatively, the process can be implemented manually by an operator.

The invention has been described in detail with particular reference to certain preferred embodiments thereof, but it will be understood that variations and modifications can be effected within the spirit and scope of the invention.

| PARTS LIST | |
|---|---|
| 10 | display monitor |
| 12 | colorimeter |
| 13 | detector |
| 14 | video switcher |
| 16 | central processing unit |
| 18 | signal generator |
| 20 | color performance before calibration |
| 22 | color performance after calibration |
| 24 | luminance range before calibration |
| 26 | luminance range after calibration |
| 100 | display patch #1 step |
| 102 | sense patch #1 step |
| 104 | compare step |
| 106 | adjust step |
| 108 | display patch #2 step |
| 110 | sense patch #2 step |
| 112 | compare step |
| 114 | adjust step |
| 116 | display patch #3 step |
| 118 | sense patch #3 step |
| 120 | compare step |
| 122 | adjust step |
| 124 | save step |

What is claimed is:

1. A method of calibrating a multichannel display device having an overall and individual channel adjustment for both gain and offset and an adjustment to provide a white point for the display, the white point including color temperature, chromaticity and luminance level, comprising the steps of:

a) displaying a first target using a low level code value for each channel of the display;

b) sensing the luminance level of the displayed first target;

c) adjusting the gain of the display so that the sensed luminance level matches a first predetermined aim value representing a luminance level at least 3 decades lower than a maximum luminance level;

d) displaying a second target using intermediate code values for each channel of the display device;

e) sensing the luminance level and chromaticities of the displayed second target;

f) adjusting the individual channel offsets so that the luminance level of the second target matches a second predetermined aim value representing an intermediate luminance level and the chromaticities match a first set of predetermined chromaticities that represent a desired white point;

g) displaying a third target using high level code values for each channel of the display;

h) sensing the luminance level and chromaticities of the displayed third target;

i) adjusting the individual channel gains so that the luminance level of the third target matches a third predetermined aim value representing the maximum luminance level and the chromaticities match the first set of predetermined chromaticities; and j) repeating steps d) through i) a number of times until no further adjustment is required in step i).

2. The method as claimed in claim 1 wherein the high level code values in step g) comprise maximum code values.

3. The method claimed in claim 1, further comprising the step of:

measuring the chromaticity and luminance level of a hard copy display medium under illumination conditions corresponding to its intended use to produce the first set of predetermined chromaticities and the desired white point.

4. The method claimed in claim 1, further comprising the steps of:

displaying one or more further targets using intermediate code values for each channel of the display device;

sensing the luminance level and chromaticities of the displayed further targets; and adjusting the individual channel offsets so that the luminance level matches the second predetermined aim value representing an intermediate luminance level and the chromaticities match a first set of predetermined chromaticities that represent a desired white point.

5. The method claimed in claim 1, further comprising the step of employing a work sheet having columns representing display code values, aim values, and gain and offset values, the gain and offset values being recorded on the work sheet as the adjustments are made.

6. A computer program product for implementing the method claimed in claim 1.

7. A display calibrated according to the method of claim 1.

8. The display claimed in claim 7, wherein the color temperature vs. code value of the display is flat to within ±200° K over the visible color range of the display.

* * * * *